US009359802B2

(12) United States Patent
James

(10) Patent No.: US 9,359,802 B2
(45) Date of Patent: Jun. 7, 2016

(54) GARAGE DOOR DRIVE APPARATUS

(75) Inventor: Gregory Brian James, Lake Munmorah (AU)

(73) Assignee: DAYLEE PTY LTD., Lake Munmorah (AU)

( * ) Notice: Subject to any disclaimer, the term of this patent is extended or adjusted under 35 U.S.C. 154(b) by 17 days.

(21) Appl. No.: 14/236,724

(22) PCT Filed: Aug. 3, 2012

(86) PCT No.: PCT/AU2012/000928

§ 371 (c)(1),
(2), (4) Date: May 6, 2014

(87) PCT Pub. No.: WO2013/016777

PCT Pub. Date: Feb. 7, 2013

(65) Prior Publication Data

US 2014/0231030 A1 Aug. 21, 2014

(30) Foreign Application Priority Data

Aug. 3, 2011 (AU) ..... 2011903113

(51) Int. Cl.

| | |
|---|---|
| ***E05F 15/681*** | (2015.01) |
| ***E05F 15/16*** | (2006.01) |
| ***E05D 15/18*** | (2006.01) |
| ***E05D 15/26*** | (2006.01) |
| ***E05F 15/668*** | (2015.01) |

(52) U.S. Cl.

CPC ..... *E05F 15/1607* (2013.01); *E05D 15/18* (2013.01); *E05D 15/262* (2013.01); *E05F 15/668* (2015.01); *E05F 15/681* (2015.01); *E05Y 2201/646* (2013.01); *E05Y 2900/106* (2013.01)

(58) Field of Classification Search

CPC ..... E05F 15/681; E05Y 2201/646
USPC ..... 49/199, 200; 160/201, 188, 189, 265
See application file for complete search history.

(56) References Cited

U.S. PATENT DOCUMENTS

| | | | | | |
|---|---|---|---|---|---|
| 1,936,300 | A * | 11/1933 | Guss | 160/133 |
| 3,280,888 | A * | 10/1966 | Davis | 160/35 |
| 4,984,387 | A * | 1/1991 | Wheatland | 49/362 |
| 5,056,847 | A * | 10/1991 | Stillwell et al. | 296/50 |
| 6,257,303 | B1 | 7/2001 | Coubray et al. | |
| 6,640,871 | B2 * | 11/2003 | Cohen-Ravid et al. | 160/188 |
| 6,719,033 | B2 * | 4/2004 | Stoltenberg | 160/188 |
| 7,372,225 | B2 * | 5/2008 | Murphy et al. | 318/280 |
| 2004/0177934 | A1 * | 9/2004 | Olmsted | 160/188 |

FOREIGN PATENT DOCUMENTS

| | | |
|---|---|---|
| DE | 20309285 | 10/2003 |
| EP | 1820928 | 8/2007 |
| WO | WO2007051237 | 5/2007 |
| WO | WO2011003152 | 1/2011 |

* cited by examiner

*Primary Examiner* — David Purol
(74) *Attorney, Agent, or Firm* — Gordon & Jacobson, P.C.

(57) ABSTRACT

A drive arrangement to open and close a door curtain of an overhead sectional door. The arrangement includes a door guide track for guiding movement of the door curtain between a closed, lowered position and an open, overhead position, and a drive mechanism for driving the door curtain between the closed and open positions. The drive mechanism comprises a drive belt located to a side of the door opening, guided to follow an inverted L-shaped locus by a drive belt guide track, a linkage between the drive belt and the door curtain, and a drive motor which drives the drive belt to open and close the door curtain as the drive belt follows the locus.

11 Claims, 10 Drawing Sheets

GARAGE DOOR DRIVE APPARATUS

BACKGROUND OF THE INVENTION

1. Field of the Invention

The present invention relates generally to overhead 'garage' doors, of the type used to close large openings in residential and commercial buildings. More particularly, the present invention relates to overhead doors of the sectional type, and to a drive arrangement for such doors.

2. Description of Related Art

Sectional garage doors are well known in the art. Although the design of sectional garage doors can significantly differ, certain components are common to such door systems. Thus a typical sectional garage door has a door curtain made of a plurality—usually four or more—panel sections hinged together at their longitudinal edges about horizontal hinge axes.

A pair of generally inverted L-shaped guide tracks is mounted to the building, one at each side of the door opening, with the vertical leg of the L being at the side of the door opening and the horizontal leg being above the level of the opening and extending back into the building space. The junction of the horizontal and vertical legs of the track is radiussed.

The door includes a plurality of rollers mounted on the opposite sides of the door sections, which follow the guide tracks to guide movement of the door curtain between a closed (lowered) position in which the door is vertical and closes off the door opening and an open (raised) position where the door is stored overhead in a horizontal orientation.

Since a sectional door is relatively large and heavy, it is commonplace to provide a counter-balancing spring system which loads up one or more torsion or extension springs as the door is lowered, so that the spring tension assists raising of the door. Such systems are commonly used even where the door is power operated.

A typical counter-balancing system includes one or more torsion springs on a horizontal torsion shaft which is secured to the building structure above the door opening. The shaft has a cable drum with a cable connected to the bottom section of the door. As the door is lowered, the withdrawal of the cable causes the shaft to turn, winding up the torsion spring. The number and size of the springs is selected so that spring tension is selected to counterbalance part of the weight of the door, so that the door is easier to raise.

One type of power operator drive mechanism comprises a motor drive and belt drive arrangement mounted on a horizontal track suspended from the building structure above and behind the centre of the door opening, parallel to but above the plane of the horizontal legs of the L-shaped tracks, with a linkage connecting to the centre top of the sectional door. This arrangement requires additional fixing and increases the headroom required for the installation, ultimately reducing the height of the door that can be installed in situations where headroom is limited.

WO 2007/051237 and WO 2011/003152 disclose garage door arrangements which the torsion spring, and optionally the motor, is mounted on the door curtain, providing advantages in manufacture and installation.

There remains a need for an improved drive mechanism for sectional garage doors.

SUMMARY OF THE INVENTION

The present invention relates to a new and inventive drive apparatus for sectional garage doors, and aims to provide a drive apparatus which may be used either with the door arrangements of WO 2007/051237 and WO 2011/003152, or with sectional garage doors of other types.

In one form, the drive apparatus comprises an elongate drive element located to a side of the door element.

In a first aspect, the present invention provides an overhead sectional door apparatus operative to open and close a door opening, including:

- a door curtain having a plurality of connected panels each having opposite side extremities;
- door guide track means for guiding movement of the door curtain between a closed, lowered position and an open, overhead position; and
- a drive mechanism for driving the door curtain between the closed and open positions, wherein
- the drive mechanism comprises a drive element located to a side of the door opening and guided to follow a locus, a linkage between the drive element and the door curtain, and a drive motor which drives the drive element to open and close the door curtain as the drive element follows the locus.

In one form, the drive element is guided in a generally inverted L-shaped locus by at least one drive guide track. Preferably the drive element is guided to follow a locus having horizontal and vertical legs generally parallel to an inverted L-shaped door guide track over at least part of the lengths of the legs of the door guide track.

In one form, the drive guide track is mounted substantially in the plane of the door guide track.

A further aspect of the invention relates to a drive apparatus for a door curtain of an overhead sectional door apparatus operative to open and close a door opening, the door apparatus having a door guide track means for guiding movement of the door curtain between a closed, lowered position and an open, overhead position, the drive apparatus including:

- a drive mechanism for driving the door curtain between the closed and open positions, wherein
- the drive mechanism comprises a drive element located to a side of the door opening and guided to follow a locus, a linkage between the drive element and the door curtain, and a drive motor which drives the drive element to open and close the door curtain as the drive element follows the locus.

Further aspects of the invention will become apparent from the claims and from the illustrated embodiments and detailed description.

BRIEF DESCRIPTION OF THE DRAWINGS

Further preferred embodiments of the invention will now be described with reference to the accompanying drawings, in which.

DETAILED DESCRIPTION OF PREFERRED EMBODIMENTS

Figure 1:
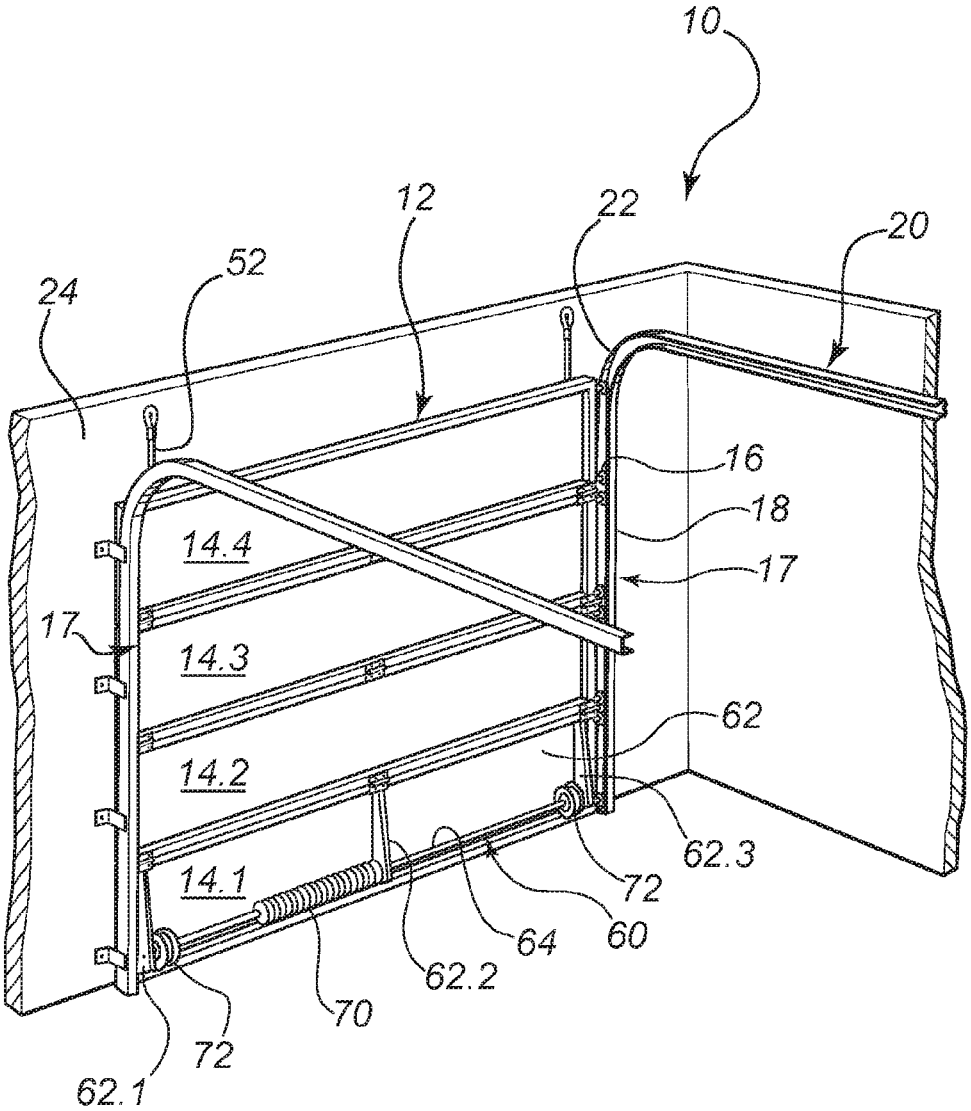
FIG. 1 is a perspective view of an example prior art sectional garage door installation.

FIG. 1 is a perspective view showing the general arrangement of components in a prior art sectional garage door installation.

The illustrated garage door installation 10 is of generally similar configuration and operation to a standard sectional garage door, including a sectional door curtain 12 made up of a plurality of sectional panels 14.1, 14.2, 14.3, 14.4 pivotably attached together, and guide wheels 16 which engage and travel within a pair of tracks 17 at each side of the door 12.

Each door guide track 17 is a channel having a vertical leg 18, horizontal leg 20 and a radiussed bend 22 in between.

A torsion spring counterbalance assembly generally referred to as 60 may typically be mounted in the headspace above the top of the door opening, or in the illustrated embodiment which may be mounted to the bottom door panel 14.1, as shown in FIG. 1 and as described in WO 2007/051237.

In the illustrated door arrangement of WO 2007/051237, a torsion shaft 64 rotates with the cable drum 32 of cable 52 to load and unload the torsion on the torsion spring 70 as the door is lowered and raised. The general construction and operation of the torsion spring arrangement will be well understood to those skilled in the relevant art.

The torsion spring assembly is secured to the panel via modified bottom stiles or muntins (vertical reinforcing members) 62.1, 62.2, 62.3 of the panel frame. To this end, the stiles 62 are tapered outwardly towards their bottom to accommodate the counter-balancing assembly 60. The side stiles 62.1 and 62.3 thus perform the function of end bracket plates of a conventional overhead counter-balancing assembly, with the similarly shaped centre stile 62.2 capable of performing the function of a centre plate.

In the prior art arrangements of WO 2007/051237 and WO 2011/003152, the bottom panel of the door may have an electric motor (not shown in FIG. 1) mounted to it for raising and lowering the door.

The contents of WO 2007/051237 and WO 2011/003152 are incorporated herein by reference.

The drive arrangement of the present invention may be used as an alternative drive apparatus for the sectional garage door and torsion spring installations of WO 2007/051237 and WO 2011/003152, or with other sectional door arrangements such as those having the torsion spring mounted overhead in the more conventional manner.

Figure 2:
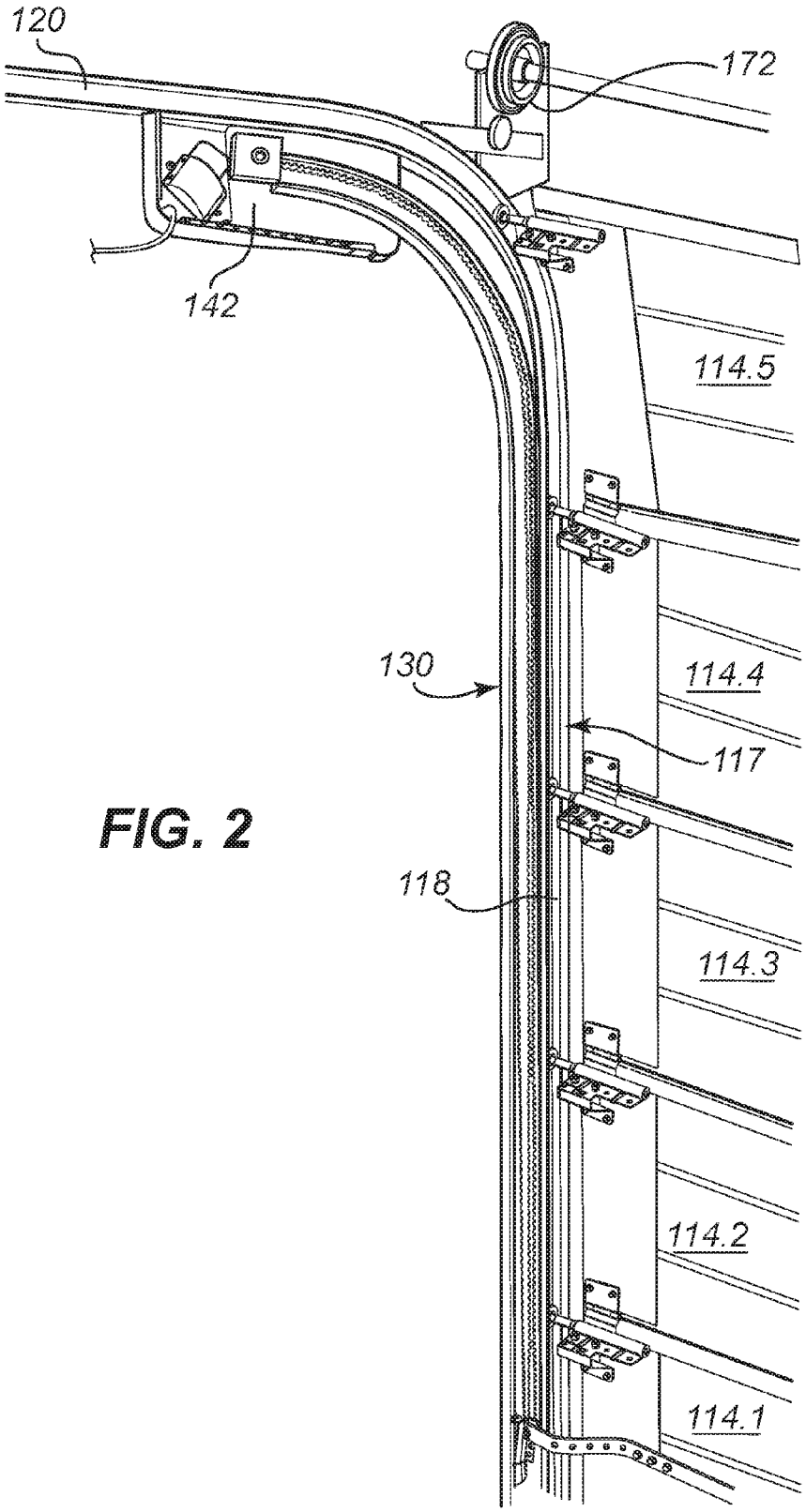
FIG. 2 is a perspective view of a drive arrangement according to one example embodiment of the invention.
Figure 3:
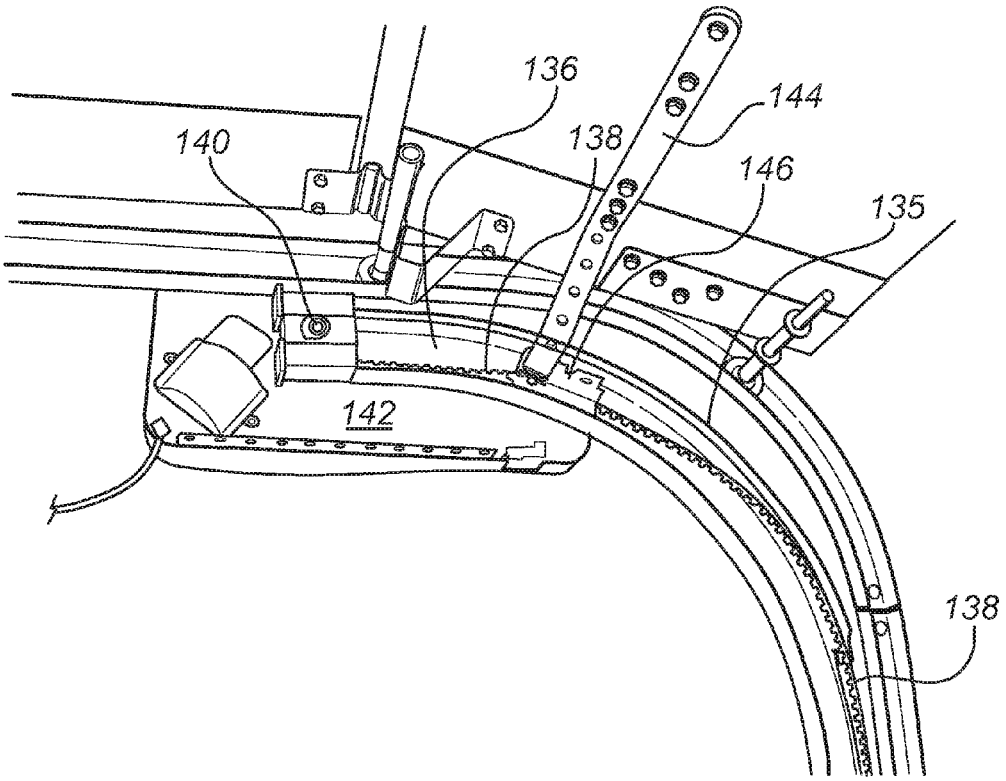
FIGS. 3 and 4 are opposite side perspectives of an upper portion of the drive arrangement of FIG. 2, with the door in the lowered position.
Figure 4:
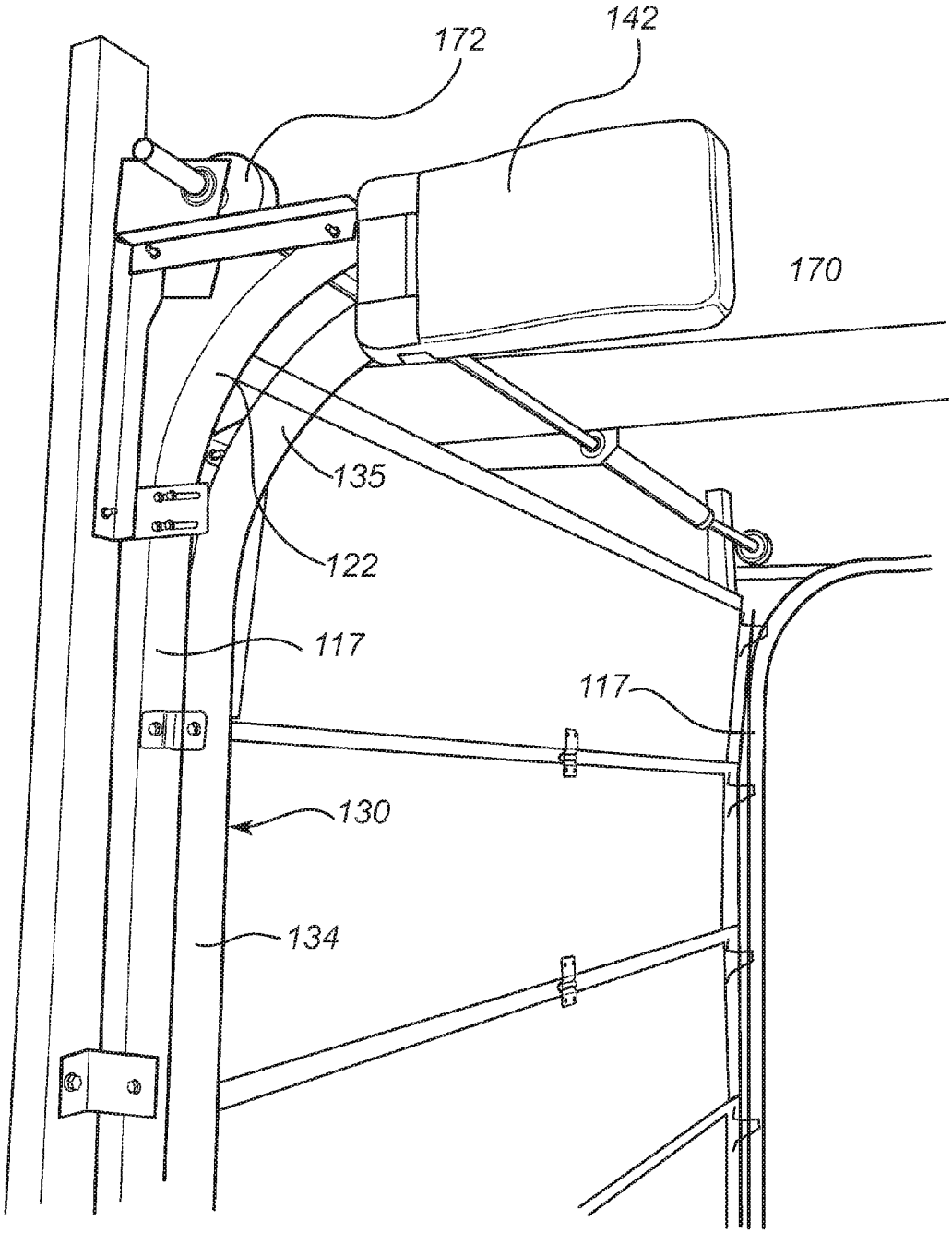
Figure 5A:
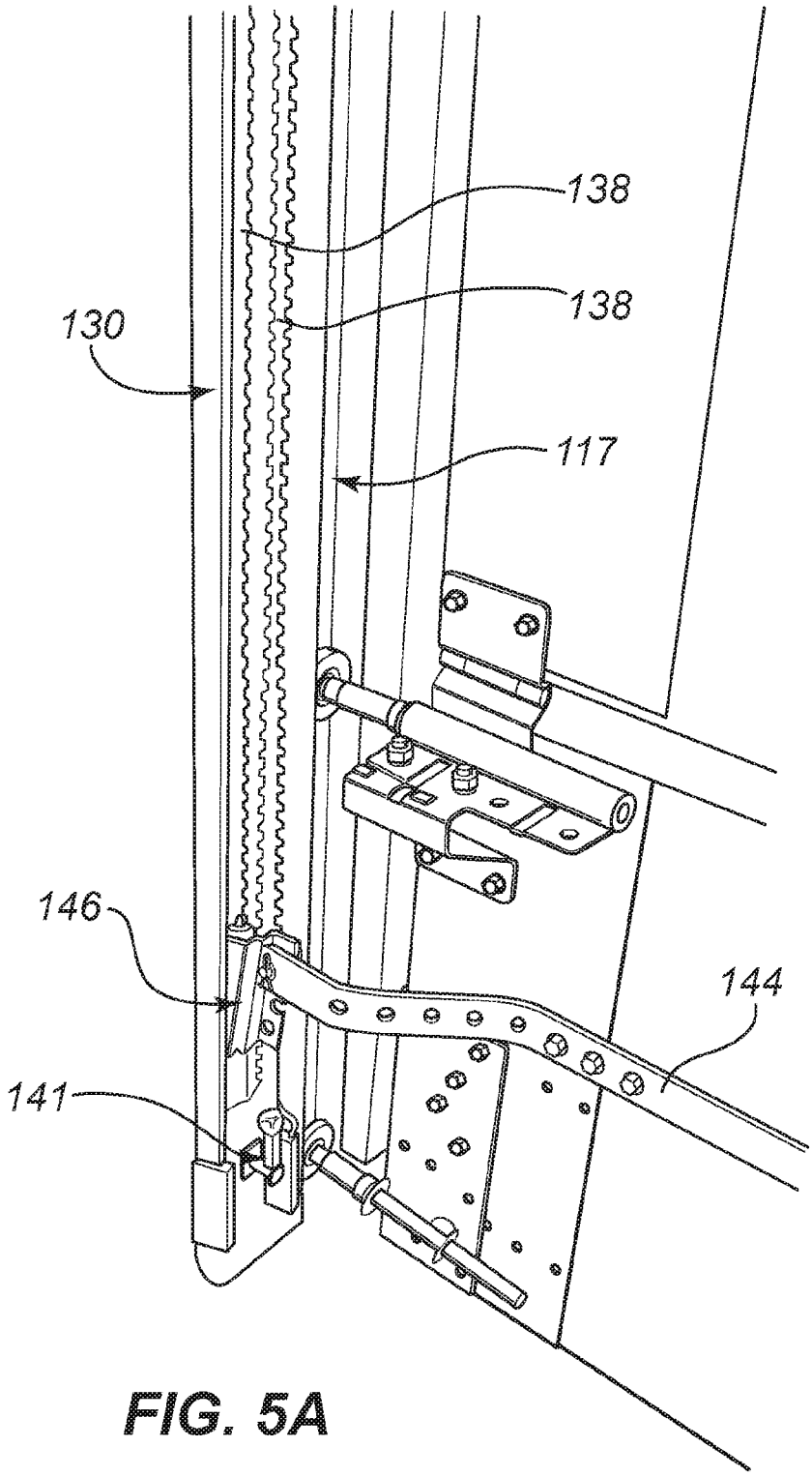
FIG. 5A is a perspective of an lower portion of the drive arrangement of FIG. 2, also with the door in the lowered position.

FIG. 2 is a perspective view of a sectional door with a drive apparatus according to one example embodiment of the invention. FIGS. 3 and 4 are opposite side perspectives of a top portion of the drive apparatus of FIG. 2, and FIG. 5A shows a bottom portion of the drive apparatus.

The general construction and mounting of the sectional door arrangement itself may be generally as described in WO 2007/051237 and WO 2011/003152 or, as illustrated, may be a conventional sectional door arrangement having the torsion spring mounted above the door opening.

The components and assembly of are generally analogous to those in FIG. 1 and are numbered with a '100-series' numerical sequence corresponding to the reference numerals used above with reference to FIG. 1, e.g. door guide tracks 117 in FIGS. 2 to 5A are similar to tracks 17 in FIG. 1.

In addition to the previously illustrated components, the sectional door arrangement of FIGS. 2 to 5C has a drive element guide track 130 mounted to be generally parallel to door guide track 117. The drive element guide track 130 is generally L-shaped channel member with a vertical leg 134, a bend portion 135 and a shortened top horizontal leg 136.

As best seen in FIG. 4, the element guide track 130 may be fixed by brackets 132 to the building structure or, more advantageously, to the door guide track 117, so as to nest inside the bend 122 of the L-shaped door guide track 117 in substantially the same plane, with the channel opening of the drive element guide track 130 facing the door opening side of the guide track. The bend 135 of the drive element guide track 130 may have a larger radius than the corresponding bend 122 of the door guide track so as to space the two tracks at that portion.

The drive element guide track 130 may be formed of any suitable construction and material, such as metal, plastics or a combination of both, but in the example embodiment of FIGS. 2 to 5C may be formed of similar track material and profile as used for door guide tracks 117.

Running inside the channel of drive element guide track 130 along at least part of its length is a drive belt 138 or other flexible drive member. Advantageously, the drive belt may comprise a drive belt of polymer material, which may be ridged or notched on one side, of the type commonly used as a drive element for sectional garage doors with an overhead drive mechanism.

The drive belt 138 engages with upper and lower drive belt pinions 140, 141 located at respective ends of the L-shaped drive element guide track 130, to form a loop which follows a closed L-shaped locus defined by the guide track 130. The drive belt 138 may generally follow the inner surface of its guide track 130 along the vertical leg 134 and the inner radius of the bend 135. At the outer surface of the bend 135, the drive belt may pass through an aperture in the outer side wall of the channel and follow around the outer surface of the guide track bend 135 at this portion, as illustrated, or alternatively the belt may remain inside the channel and an additional guide member (not shown) may be provided inside the channel to hold the drive belt clear of the inner bend surface.

At the end of the top horizontal leg 136 is mounted a remote-controlled, reversible electric drive motor 142, which may be of a type known per se for garage door installations. The drive motor 142 drives the upper drive belt pinion 140 to rotate in one direction to drive the drive belt in a first direction, and in the opposite direction to induce movement of the drive belt in the second, opposite direction.

The drive motor may be mounted via brackets to one or both of the guide tracks 117, 130, and additionally may be supported back to the building structure if required. Contrary to the illustration of FIG. 4, the drive motor 142 may be mounted so that the body of the motor is on the door opening side of the guide track 130 and the light which is commonly included in motor units of this type illuminates the door opening when the motor is in operation.

As seen in FIGS. 2 and 5A, the bottom panel 114.1 of the sectional door has a linkage member 144 which links to a carriage 146 which connects the door panel to the drive belt, advantageously to that part of the drive belt which follows the inner surface of the bend of the guide track 130. Thus, when the drive pinion 140 is rotated by the motor 142 to move the drive belt in a first direction the carriage will follow the drive belt up the vertical leg and at least partly around the bend 135 of the guide track 130 to raise the door clear of the door opening, and driving the motor in the opposite direction will close the door.

Figure 5B:
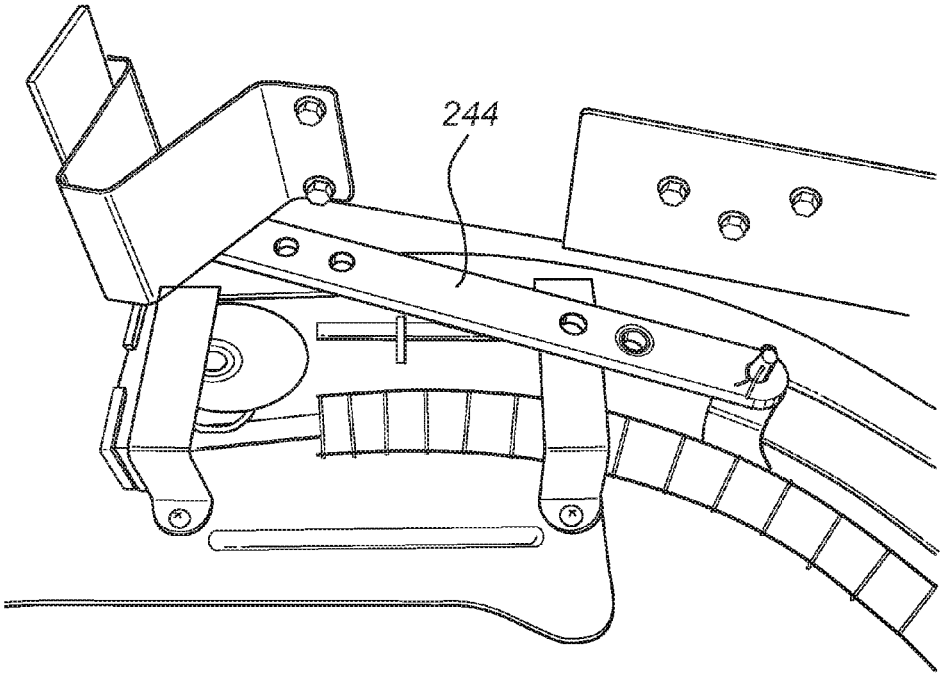
FIG. 5B is a perspective view of another example embodiment of a linkage member.
Figure 5C:
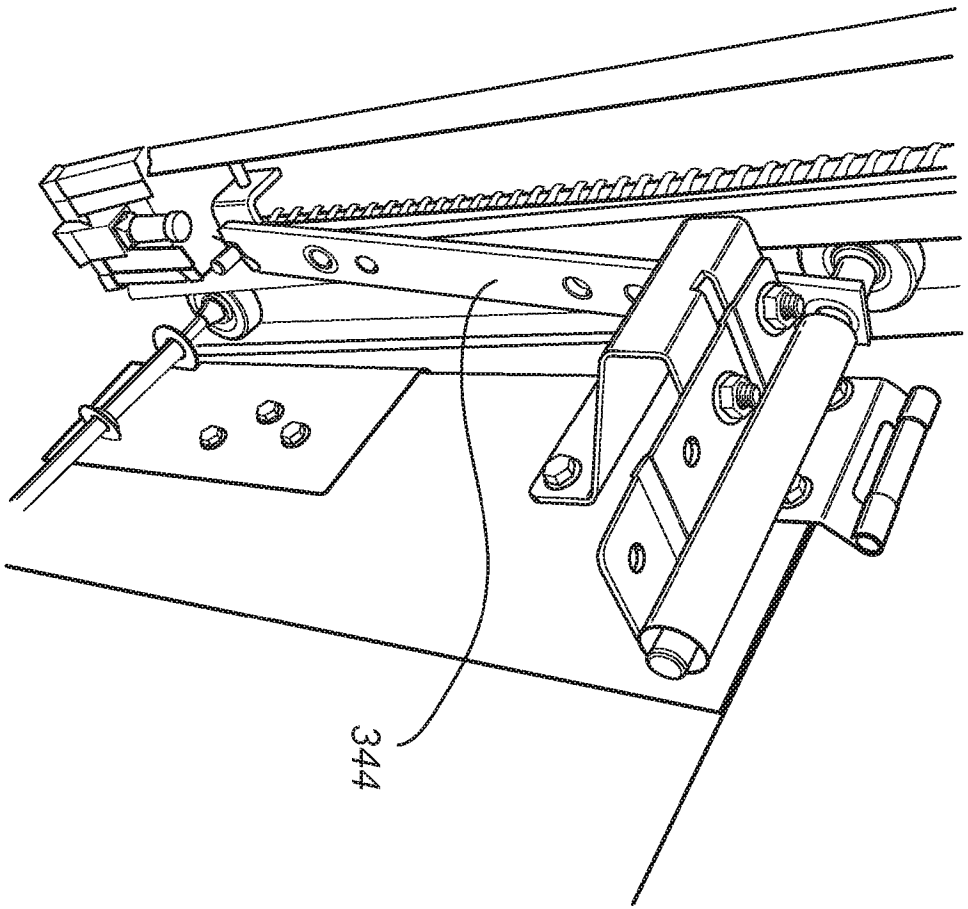
FIG. 5C is a perspective view of another example embodiment of a linkage member.

Further examples of linkage members 244 and 344 are shown in FIGS. 5B and 5C, respectively.

Alternative disengagement mechanisms may be provided for allowing manual operation of the door in event of power failure or the like. In a first disengagement mechanism, the carriage 146 may be of a known type which has a disengagement lever or the like which may be operated to disengage the carriage from the drive belt. Such carriage mechanisms are known per se in the art.

Alternatively, and preferably, the motor may have a user operable clutch mechanism to disengage the pinion 140 from the motor to allow freewheeling. In such arrangements, the motor unit will preferably include also an indexing mechanism, such as an optical encoder which keeps track of the position of the door. Commercially available examples of such motor units include garage door operator models GDO-6 and GDO-10 available from Automatic Technology Australia.

The example drive apparatus described above thus provides a convenient, easily-fitted drive mechanism for a sectional garage door which overcomes the installation difficulties and headroom restrictions which may be encountered with some of the prior art drive mechanisms. The example drive mechanism—including the drive belt guide track, drive belt, pinions, motor and linkages—may be provided as part of a complete door installation, or as a retrofit or optional kit for adding to an existing door.

Furthermore, many of the parts of the presently described example drive apparatus are readily sourced as being already in use for other applications in the field.

Figure 6:
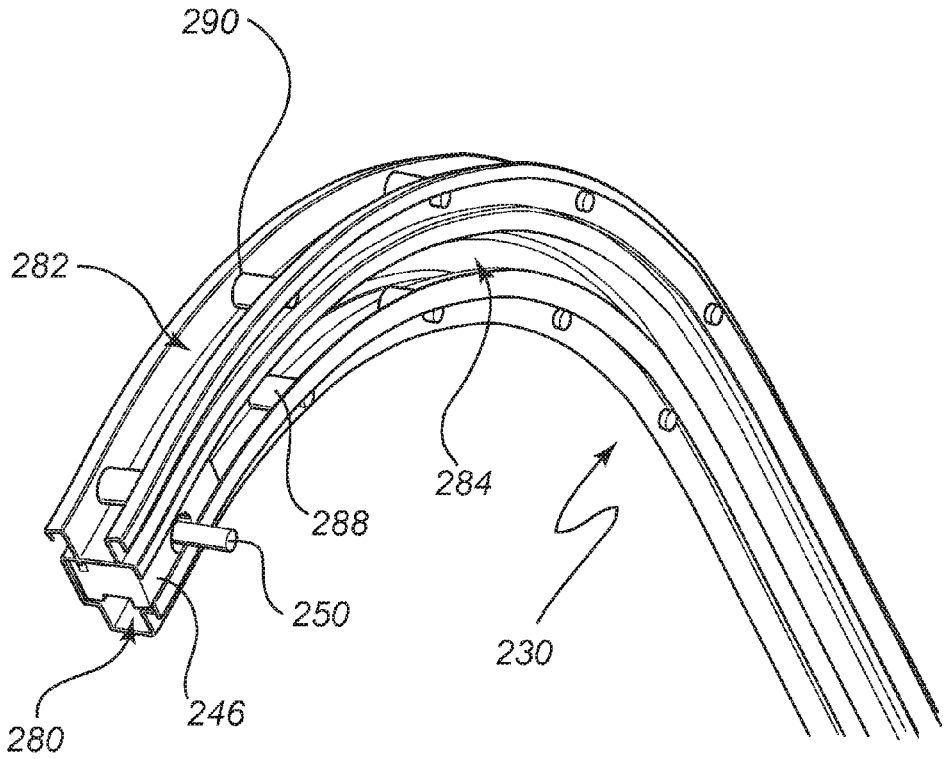
FIG. 6 is a perspective view of a portion of a drive element guide track according to a second example embodiment.
Figure 7:
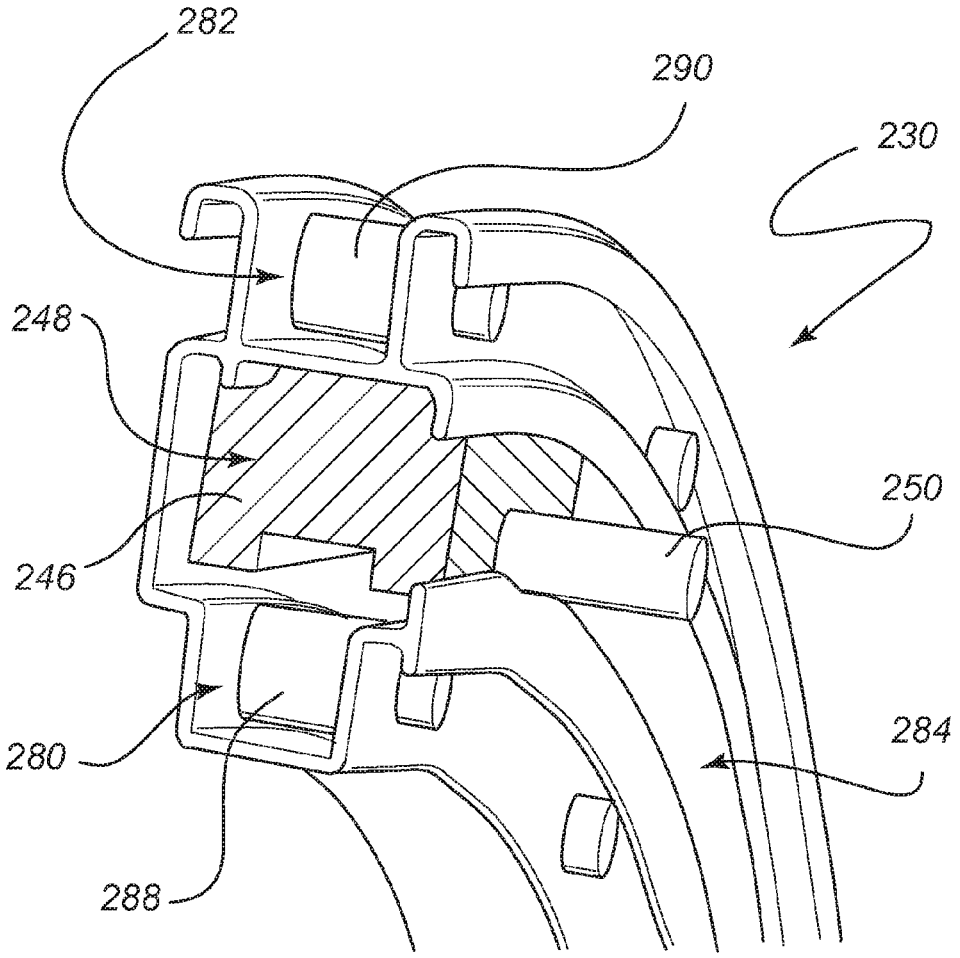
FIG. 7 shows the drive element guide track of FIG. 6 in more detail.

FIGS. 6 and 7 show an alternative drive element guide track 230 and carriage 246 arrangement, according to a second example embodiment.

As best seen in FIG. 7, the drive element guide track 230 profile comprises three channel portions: an inner drive belt channel 280 closest to the inner radius of the bend portion of the track; an outer drive belt channel 282 on the outside of the bend portion radius; and a central carriage channel 284 which guides the carriage 246. The track profile is formed to provide an opening between the inner drive belt channel 280 and the central carriage channel 284 to accommodate the attachment of the carriage 246 to the drive belt (not shown in these views).

The inner 280 and outer 282 drive belt channels each have a series of idler rollers 288, 290 which help guide the belt around the bend portion of the track 230. The rollers 288 of the inner channel 280 have a smooth surface profile, being in contact with the plain face of the notched drive belt, while the rollers 290 of the outer channel 282 have a ribbed profile to match the ribbed side of the drive belt with which they will be in contact.

The drive element guide track construction of FIGS. 6 and 7 may be formed of any suitable material and construction, but may advantageously be formed in sections of cast or extruded metal such as aluminium, or by injection moulding of suitable polymer material. By forming the track in sections, storage and transport requirements are reduced. Also, the height of the vertical leg of the inverted L-shaped guide track 230 may be adjusted to suit the height of the door opening.

The carriage 246 as illustrated includes a carriage body 248 which fits within the central channel 284, and a protruding pin 250 extending through an aperture in the side wall of the central channel 284 for attachment of a linkage member (not shown) to attach the carriage to the door curtain. In an unillustrated aspect of this embodiment, the linkage member may extend between the protruding pin 250 and an axle of an adjacent door wheel assembly, such that the linkage to the door curtain is via the wheel axle rather than direct to the door curtain itself, the attachment of the ends of the linkage member to both the pin and the axle being adapted to allow pivoting as the carriage passes through the bend portion of the track.

Figure 8:
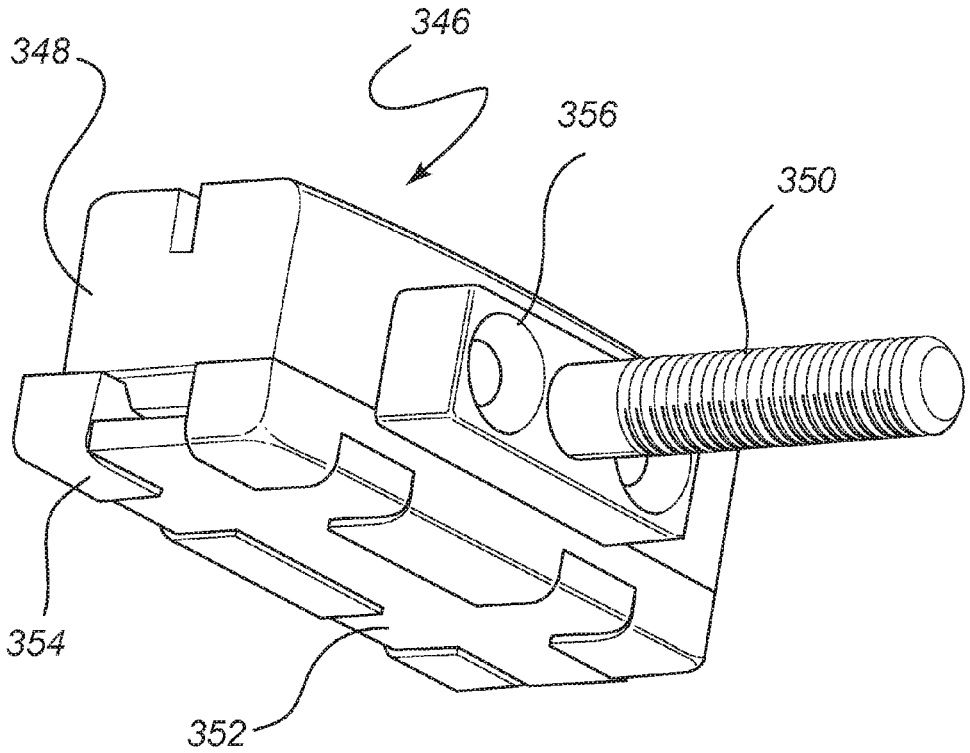
FIG. 8 is a perspective view of a carriage assembly according to a third example embodiment.

FIG. 8 illustrates a further example embodiment of a carriage assembly 346 which may be used with the embodiment of FIGS. 6 and 7.

The carriage 346 of FIG. 8 has a carriage body 348, for example of aluminium or other suitable material, which is guided within the central channel 284 of the guide track 230. At the base of the carriage body is a clamping member 352—also of metal or suitably robust material—which is attached by screwing or similar of the body 348 so as to form a space for the drive belt to be clamped therebetween. The bottom surface of the body 348 may be ridged to match the ridged side of the drive belt with which it will be in contact.

The clamping member 352 may have a skid member 354 of PTFE or other friction-reducing material, to reduce drag as the carriage moves along the guide track 230.

At the side of the carriage body 348 is an attachment block 356 which attaches the protruding pin 350, generally similar to that described above with reference to FIGS. 6 and 7 in both construction and purpose.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise, comprised and comprises where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, the scope of the invention being indicated by the appended claims rather than the foregoing description, and all changes which come within the meaning and range of equivalency of the claims are therefore intended to be embraced therein. It will further be understood that any reference herein to known prior art does not, unless the contrary indication appears, constitute an admission that such prior art is commonly known by those skilled in the art to which the invention relates.

The invention claimed is:

1. An overhead sectional door apparatus operative to open and close a door opening, including:

a door curtain having a plurality of connected panels each having opposite side extremities;

a pair of inverted L-shaped door guide tracks at opposed sides of the door opening, each comprising a vertical leg adjacent the door opening, an upper horizontal leg extending away from the door opening and a radiussed bend therebetween, for guiding movement of the door curtain between a closed, lowered position and an open, overhead position; and a drive mechanism for driving the door curtain between the closed and open positions, wherein the drive mechanism comprises (a) an inverted L-shaped drive element guide track mounted substantially in the plane of the one of the pair of door guide tracks and nested within the L-shape of said door guide track, (b) a drive element located to a side of the door opening and guided by the drive element guide track to follow a locus, a linkage between the drive element and the door curtain, and (c) a drive motor located at the horizontal leg of the drive element guide track which drives the drive element to open and close the door curtain as the drive element follows the locus.

2. A door apparatus according to claim 1, wherein the drive element guide track has horizontal and vertical legs generally parallel to respective legs of said inverted L-shaped door guide track, and a radiussed bend spaced from the radiussed bend of the door guide track.

3. A door apparatus according to claim 2, wherein the horizontal leg of the drive element guide track is shortened relative to the horizontal leg of the door guide track.

4. A door apparatus according to claim 1, wherein the drive element is a drive belt loop guided to follow said inverted L-shaped door guide track.

5. A door apparatus according to claim 4, wherein the linkage between the drive element and the door curtain includes a carriage member connected to the drive belt and a linkage member which transfers travel of the carriage to the door curtain.

6. A door apparatus according to claim 4, wherein a linkage member attaches at one end to the carriage and at another end to an axle of a wheel member of the door curtain.

7. A drive apparatus for a door curtain of an overhead sectional door apparatus operative to open and close a door opening, including:

a pair of inverted L-shaped door guide tracks at opposed sides of the door opening, each comprising a vertical leg adjacent the door opening, an upper horizontal leg extending away from the door opening and a radiussed bend therebetween, for guiding movement of the door curtain between a closed, lowered position and an open, overhead position; and a drive mechanism for driving the door curtain between the closed and open positions, wherein the drive mechanism comprises (a) an inverted L-shaped drive element guide track mounted substantially in the plane of the one of the pair of door guide tracks and nested within the L-shape of one of said door guide tracks, (b) a drive element located to a side of the door opening and guided by the drive element guide track to follow a locus, a linkage between the drive element and the door curtain, and (c) a drive motor located at the horizontal leg of the drive element guide track which drives the drive element to open and close the door curtain as the drive element follows the locus.

8. A drive apparatus according to claim 7, wherein the drive mechanism is adapted for retro-fitting to an installed door arrangement including said pair of inverted L-shaped door guide tracks.

9. A door apparatus according to claim 8, wherein the drive element is a drive belt loop guided to follow said locus by said inverted L-shaped drive element guide track.

10. A door apparatus according to claim 1, wherein the drive motor is mounted at a distal end of the horizontal leg of the drive element guide track.

11. A drive apparatus according to claim 1, wherein the drive motor is mounted at a distal end of the horizontal leg of the drive element guide track.

* * * * *